US006138603A

United States Patent [19]

Taylor

[11] Patent Number: 6,138,603

[45] Date of Patent: Oct. 31, 2000

[54] ANCHOR WITH TRAPEZIFORM FLUKE

[76] Inventor: James Matthews Taylor, 6501 Red Hook Plz., Suite 201, St. Thomas, Virgin Islands (U.S.) 00802-1305

[21] Appl. No.: 09/164,029

[22] Filed: Sep. 30, 1998

[51] Int. Cl.[7] ..... B63B 21/38

[52] U.S. Cl. ..... 114/304

[58] Field of Search ..... 114/301, 304, 114/306

[56] References Cited

U.S. PATENT DOCUMENTS 4,073,256 2/1978 Rossini ..... 114/306

4,418,635 12/1983 Taylor ..... 114/304

*Primary Examiner*—S. Joseph Morano

*Assistant Examiner*—Andrew D. Wright

*Attorney, Agent, or Firm*—Felsman, Bradley, Vaden, Gunter & Dillon LLP

[57] ABSTRACT

An anchor in which an L-shaped shank has a single trapeziform fluke pivotally secured to the shorter leg of the L provides a larger surface area for the palm of the fluke. The fluke is configured such that a center of force is directed perpendicularly to the shorter leg of the L to minimize the tendency of the anchor to move sideways or crab.

16 Claims, 7 Drawing Sheets

ANCHOR WITH TRAPEZIFORM FLUKE

FIELD OF THE INVENTION

The present invention relates to anchors which are commonly used for mooring ships, boats, and other types of marine craft. More particularly, this invention relates to a single-fluke anchor which maintains a perpendicular when engaging bottom material, even as the effective area of the single fluke is enlarged.

BACKGROUND OF THE INVENTION

Anchors have been used for centuries and generally comprise two essential elements: a shank and at least one fluke. To properly function, the fluke(s) should engage the bottom of the body of water, such as a lake bottom or a sea floor. The fluke is generally secured to one end of the shank. The other end of the shank is joined to a cable which, in turn, is tied to the craft.

Beyond these essential common elements, anchor designs vary widely. One reason for the variety of anchor designs is the variety in the types of bed soil conditions that are encountered in moorings. Thus, soils may be sandy, rocky, hard or soft, have plant growth, or any combination of these soil conditions. One previous anchor which was designed to engage all types of soil conditions satisfactorily was disclosed in my U.S. Pat. No. 4,418,635, incorporated herein by reference.

While the design the '635 patent was effective in engaging the various types of soil commonly encountered in moorings, it did not solve all the drawbacks of previous anchor designs. Anchor designs prior to that of the '635 patent shared an inherent flaw, the inability to bite through the first layers of bottom material to the more finely compacted composition below that provides greater holding power. The overlying material often contains grass, weed, coral and shell parts, and other loose debris that provide little or no holding force for an anchor, while the material below provides much greater holding force. Previous anchor designs had trouble penetrating the overlying layer due to the position of the shank, which on prior anchor designs was placed at the center of the anchor's flukes. As the center-shanked anchor is setting, the shank attempts to divide the mass of bottom material equally as it is supplied by the anchor's flukes. This inevitably results in the accumulation of incompatible bottom material at the shank in interfering with penetration to the better holding hardpack below.

The anchor of the '635 patent was designed with the shank away from the fluke to help avoid the predisposition to clog, yet retain balance under load so the anchor would not "roll out" but remain oriented to penetrate through the poor holding overlying bottom material. The triangle-shaped fluke of that anchor achieved its goal to feed through poor holding bottom material but because the center of gravity or center of effort of the triangle fluke was off-center of the preferred maximum resistance orientation of perpendicular, an adverse side effect was created. This is the tendency to "crab" or move diagonally through the bottom from the load imposed by the water craft. This lessened holding power as the triangular fluked anchor of the '635 patent "slipped" or clutched", allowing the craft to move back and away, commonly called "dragging" in the art. The triangular shaped fluke also restricted the fluke area by limiting its size.

Any increase in size or extension of the triangle only moves the center of effort further from perpendicular, thereby exaggerating the diagonal movement. The limited size of the triangular fluke also impairs proper penetration in softer bottoms such as mud and grainy sand as the resistance in these bottoms is insufficient to pull the anchor further down to better holding bottom compositions without an adequate amount of fluke area to create enough resistance to facilitate further penetration.

This phenomenon therefore dictates a certain tradeoff, the fluke must be made large enough to provide sufficient surface area for adequate holding power, but the greater the surface area of the triangular fluke the greater the tendency to crab. Thus, there remains a need for a fluke that can provide the necessary large surface area while eliminating the side force generated by the triangular fluke.

SUMMARY OF THE INVENTION

The present invention addresses these and other drawbacks of the anchor designs known in the art. The present invention provides an anchor having a fluke in the shape of a trapezium and the fluke is offset from the shank to take advantage of my design of the '635 patent to reduce the effects of clogging by the shank. The center of effort of the trapezium-shaped (trapeziform) fluke is moved to the preferred perpendicular position to the anchor shank, duplicating the ideal balance achieved in symmetrical anchors. The trapeziform fluke also permits the addition of fluke area or size without sacrificing this balance, thereby increasing resistance in softer bottoms permitting quicker and more efficient penetration to the good holding composition below.

While there have been a variety of different anchor types, their respective construction may be conveniently viewed with the fluke being either symmetrical or quasi-symmetrical about a principle plane defined by the shank. In "symmetrical" anchors, the fluke is either fixed or pivotally secured to the shank and the major surface or surfaces of the fluke palm remains disposed symmetrically with reference to the plane of symmetry of the shank. This feature is provided so that the anchor bites straight down through the overlying layers into the hardpack below, rather than rolling or crabbing.

Quasi-symmetrical anchors are those in which a fluke is disposable symmetrically about a principally symmetrical plane of the shank, but pivotally secured to assume asymmetrical positions with respect to the principle plane.

Thus, it is an object of this invention to provide an anchor which is simple in use and economic, to manufacture. The anchor of this invention provides an enhanced surface area of the fluke, while reducing the tendency of the anchor to crab by maintaining a perpendicular center of effort of the fluke.

It is another object of this invention to provide an anchor which provides improved moorage to beds regardless of the type of soil and condition of the anchorage.

In furtherance of these objectives and others that will become more apparent in the following discussion, there is provided, in accordance with the teachings of this invention, an anchor having a trapeziform fluke lying within a plane. A fluke is pivotally secured to the shank so as to be pivotal about an axis within the shank. The fluke and the shank move together within the plane. The principal plane of the fluke is disposable so as to be co-planar with the shank plane. As the area of the trapeziform fluke is increased to provide greater holding force, the area on either side of a line from the shackle on the end of the shank to a perpendicular "force point" is maintained in equal area.

These and other features of the present invention will be apparent to those of skill in the art from a review of the following detailed description along with the accompanying drawings.

DESCRIPTION OF THE PREFERRED EMBODIMENTS

As previously indicated, a disadvantage of prior art anchors is the limitation on the total surface area of the fluke in an asymmetrical anchor. In the following discussion, the terms "forward" and "rear" are used with reference to the general direction of movement of an anchor when being moved into operation by the pull of a cable. The term "bottom" or "bed", unless specifically qualified, refers to the ground beneath a body of water.

Figure 1:
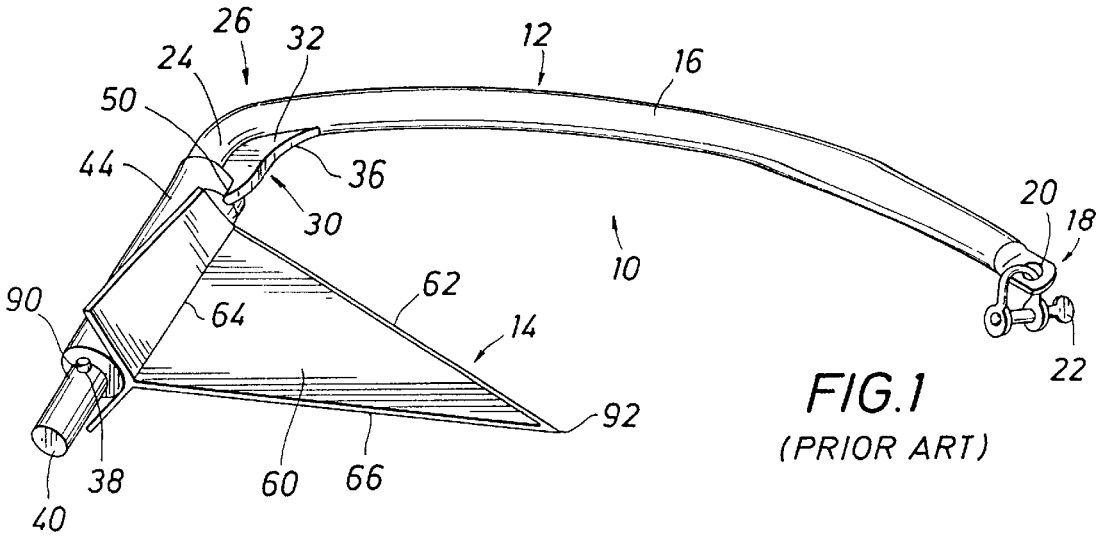
FIG.1 (PRIOR ART)
FIG. 1 is a perspective view of a prior art anchor constructed in accordance with the teachings of my U.S. Pat. No. 4,418,635.

FIG. 1 depicts the prior art anchor of my '635 patent. An anchor 10 generally comprises a shank 12 and a fluke 14. The shank 12 may be generally L-shaped, lying generally in a plane, and have a major leg 16 which may have generally arcuate shape. Preferably, the major leg 16 is in the shape of an arc of a circle.

The forward or shackle end of 18 of the major leg 16 has therein an aperture 20 for receiving a cable shackle 22. A shorter "L" leg 24 extends perpendicular from the rear end 26 of the major leg 16 and extends in a direction generally radially inward from the arc formed by the major leg 16.

A web member 30 may be joined at the juncture of the two legs 16 and 24 of the shank 12. The shank 12 may be formed of any well known rigid structural material commonly used in anchors, such as steel or the like. The web member 30 may be made of the same material and joined to the shank 12 by any commonly known manner, such as welding, casting, or the like.

The web member 30 may have a generally planar surface 32 and terminate in an arcuate edge 36 having a concavity having the same general radius as the arcuate major leg 16. The web member 30 serves to strengthen the juncture of the legs 16 and 24 of the L-shaped shank 12.

The shorter leg 24 receives the fluke and has an aperture 38 in its free end 40 to receive a pin 90 to retain the fluke while permitting its rotation about the leg 24.

The fluke 14 may include a hollow, cylindrical member 44. The cylindrical member's interior diameter is dimensioned as to receive the shorter "L" leg 24 of the shank 12. The end of the cylinder 44 which is intended to be disposed adjacent to the juncture of the legs 16 and 24 of the shank 12, has therein a notch 50. The notch 50 serves to locate the cylinder 44 on the L-leg 24 of the shank 12 and provides a selected angular range of movement of the fluke 14.

Figure 2A:
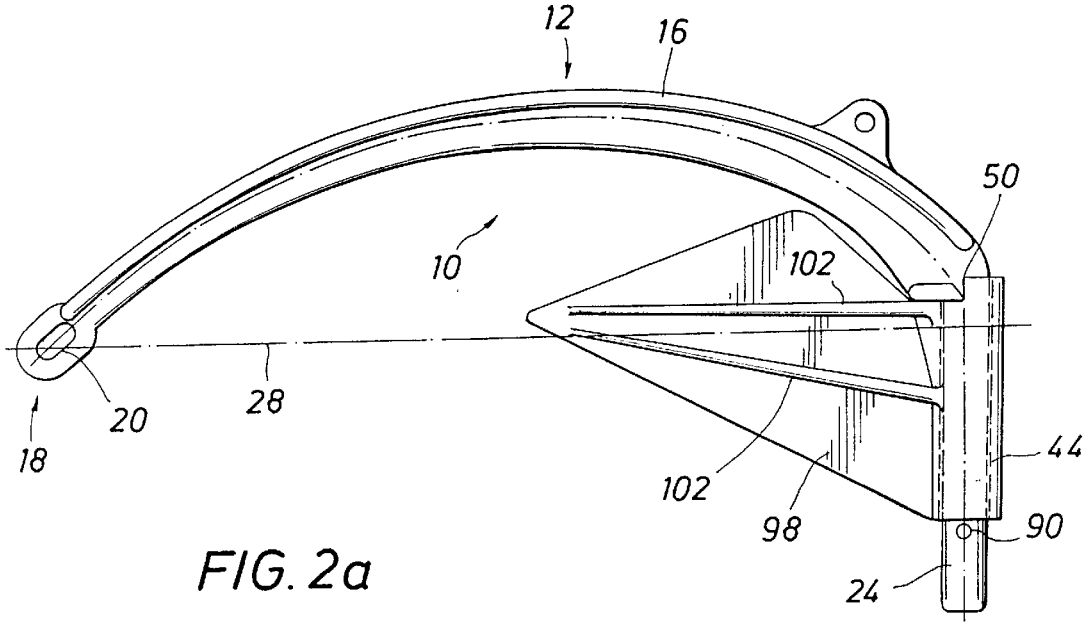
FIG. 2*a* is a plan top view of the anchor constructed in accordance with this invention.

The fluke 14 further includes a palm 60 which is, in this prior art anchor of FIG. 1, in the shape of a planar right angle triangle. As shown in FIG. 2*a,* in the preferred embodiment of the present invention, the palm is in the shape of trapezium. In the prior art anchor of FIG. 1, one right-angle side edge 62 of the triangular palm 60 is disposed to be co-terminus with an imaginary line which may extend substantially perpendicular to the L-leg 24 and through the shackle end 18 of the arcuate leg 16 of the shank 12 (shown more clearly in FIG. 3*a*).

The imaginary line between the L-leg and the shackle end for the present invention is shown more clearly in FIG. 2*a*. In order to increase the surface area of the fluke, if one simply makes the triangular palm of FIG. 1 larger, then the enter of force of the fluke is moved further off this imaginary line 28, thereby exacerbating the tendency of the fluke to pull to the side and therefore drag. The present invention, as shown in FIGS. 2*a,* 2*b,* 3*b,* and 4*b,* permits the enlargement of the fluke, while maintaining the center of force substantially on the line 28, and therefore providing a force perpendicular to the axis of the leg 24.

Referring again to FIG. 1, right angle base edge 64 of the palm 60 is secured to the cylindrical member 44 as by welding or the like. The palm 60 may extend outwardly, substantially radially from the cylinder 44. The edge 62 is substantially co-terminus with the bottom radial wall of the notch 50. The base edge 64 is preferably at right angles to the top marginal edge 62. The lower marginal edge 66 completes the triangular shaped palm 60.

Figure 2B:
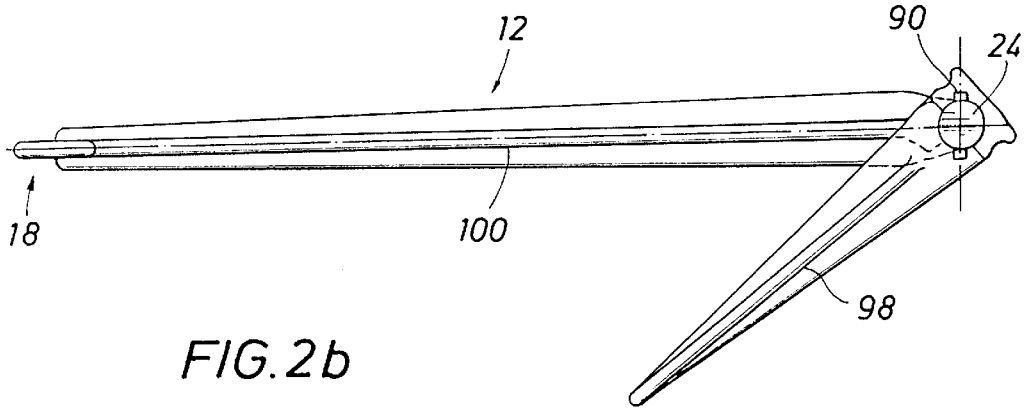
FIG. 2*b* is a side view of the anchor of this invention.

FIGS. 2*a* and 2*b* depict a preferred embodiment of the anchor of this invention, including the trapeziform fluke 98. This embodiment includes the cylindrical member 44 mounted to the leg 24 for rotational movement within the limitations set by the notch 50. The shank 12 lies substantially in a plane 100 (indicated in edge by the dashed line 100 in FIG. 2*b*). The other end of the shank 12 includes a forward or shackle end 18 with an opening 20.

The fluke is mounted as by welding to the cylindrical member for rotational movement, and includes one of more ribs or stiffeners 102. The fluke 98 is shaped so that force on the fluke is approximately divided equally on either side of the imaginary line 28. In this way, the surface area of the fluke 98 may be increased while minimizing the tendency of the anchor to slide in direction transverse to the line 28, thereby enhancing the desired performance of the anchor. This feature of the present invention is shown most clearly is FIGS. 3*b* and 4*b* and will now be described.

Figure 3A:
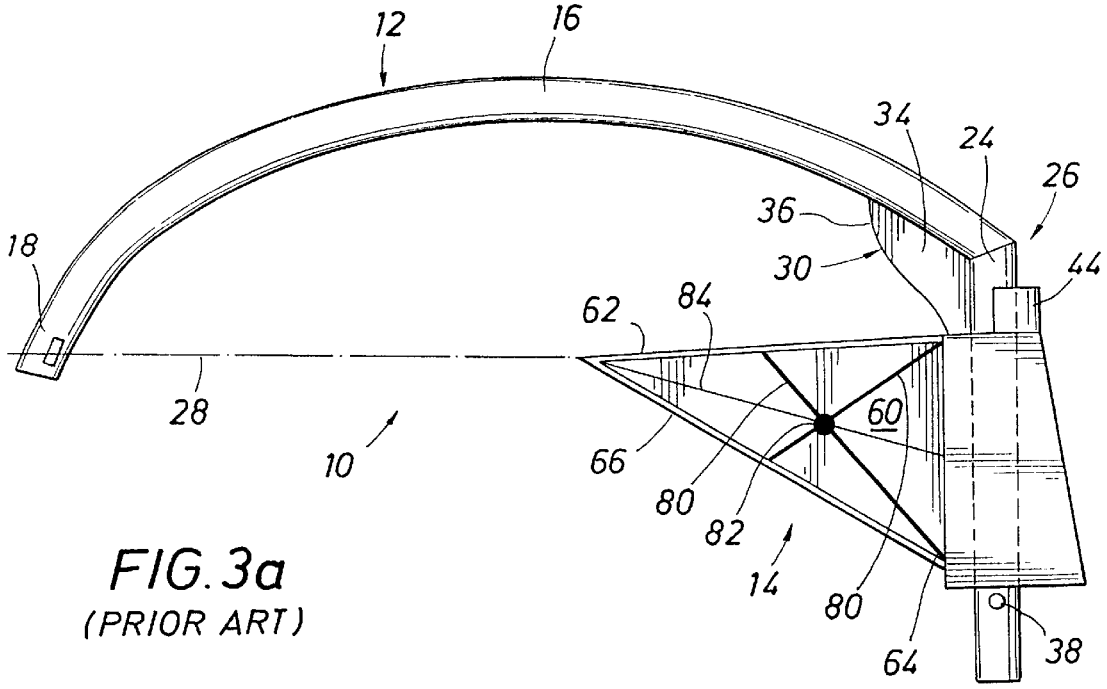
FIG. 3a (PRIOR ART)
FIG. 3*a* is a plan top view of a prior art anchor showing the center of effort offset from a line from the end of the shank to a vertical point on the shank.

FIG. 3*a* shows a pair of schematic lines 80 which are drawn from the midpoint of the sides 62 and 66 to the corners opposite these sides. The intersection of these schematic lines is numbered 82 in FIG. 3*a,* and denotes the geometric center of the palm 60. This geometric center is tantamount to the center of force, if force is equally applied throughout the palm. For the purposes of the triangular shaped fluke of FIG. 3*a,* this assumption has proved accurate, since as the fluke bites deeper into the bottom, larger and larger similar triangles encounter bottom matter and the center of force moves, but always along a line 84. Similarly, as the palm 60 is made larger and larger, the center of force moves further and further off the line 28 which denotes the point of vertical force against the vertical shank portion 24.

Figure 3B:
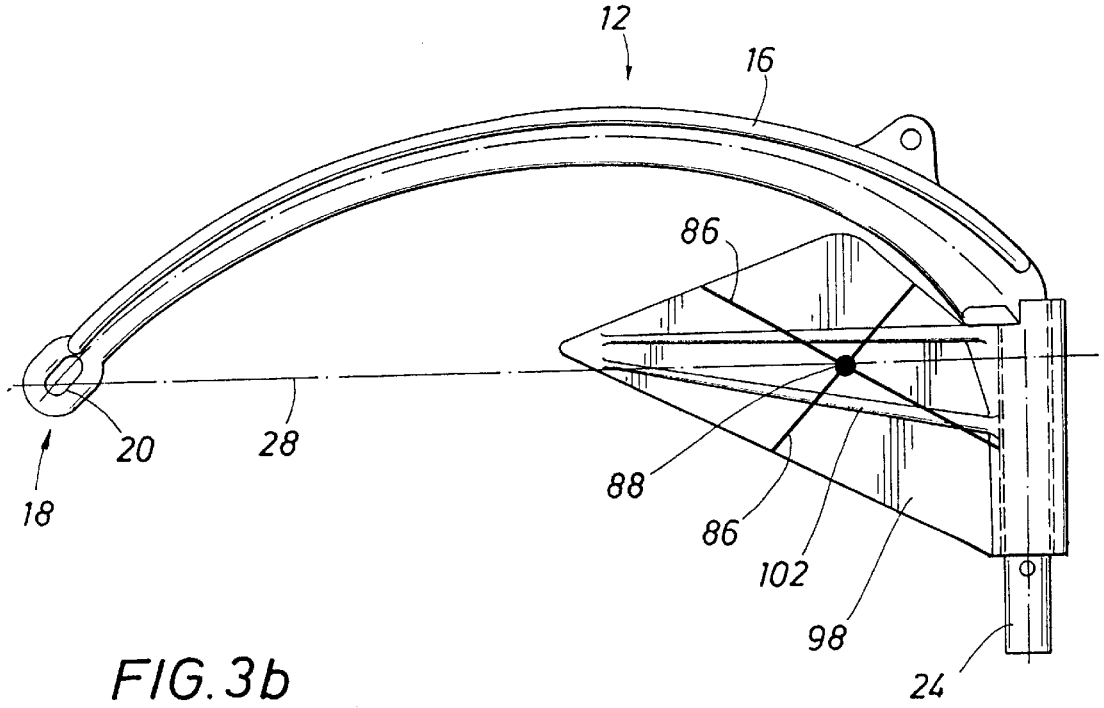
FIG. 3*b* is a plan top view of the anchor of this invention showing the center of effort on the line from the end of the shank to a vertical point on the shank.

But, with the trapeziform fluke of the present invention and shown in FIG. 3*b,* a pair of schematic lines 86, originating at the midpoints of opposite sides of the fluke intersect at a geometric center 88 of the palm 98. This geometric center is also tantamount to the center of force and remains on the line 28, regarding less of the size of the palm 98. In this way, the holding force generated by the fluke and transferred to the shank is applied vertically, there by minimizing the tendency of the anchor to crab.

Figure 4B:
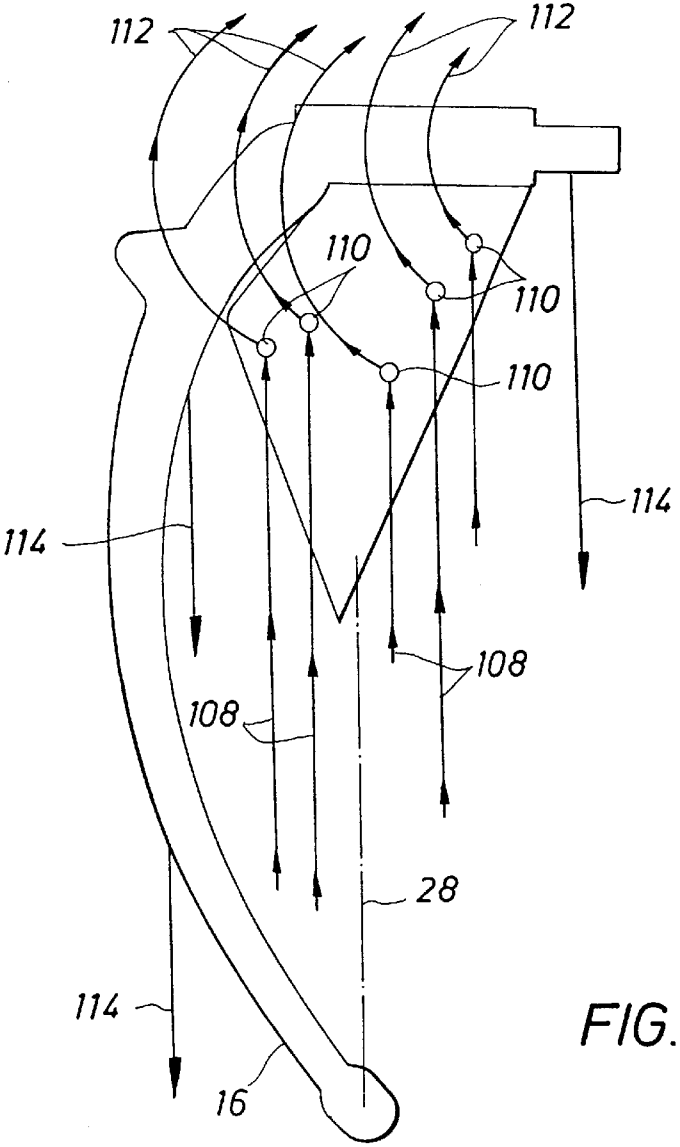
FIG. 4*b* is a plan top view in silhouette of an anchor of this invention showing the force effects of a trapeziform fluke when the center of effort is maintained on the line from the end of the shank to a vertical point on the shank.
Figure 4A:
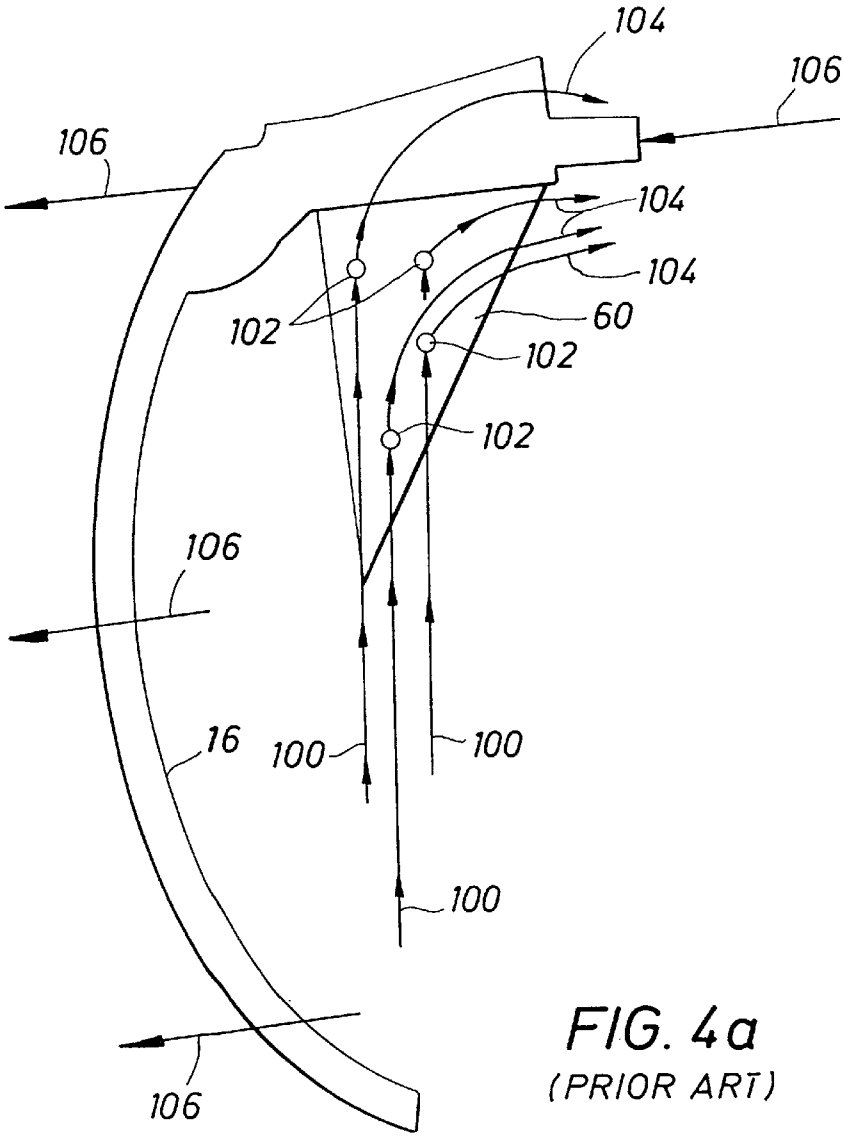
FIG. 4a (PRIOR ART)
FIG. 4*a* is a plan top view in silhouette of a prior art anchor showing the force effects of triangular-shaped fluke.

This phenomenon is shown from another aspect in FIGS. 4*a* and 4*b*. In these figures, the prior art anchor and the anchor of the present invention are shown with the shank in silhouette. In FIG. 4*a,* bottom matter, shown schematically as a series of arrows 100, strikes the fluke 60, such as at various points 102. The fluke plows the bottom matter off to the side, as shown by the series of arrows 104. This movement of the bottom matter develops side force, shown by a series of arrows 106. This side force results in crabbing of the anchor. This side force is minimized by the present invention, as shown in FIG. 4*b*. Bottom matter 108 strikes the trapeziform fluke 98 at various points 110, and is forced off the fluke, as shown by the arrows 112. This movement of the bottom matter creates a vertical force as shown by the arrows 114, thereby minimizing the sideways force and driving the fluke straight down into the sea bottom.

Figures 5A, 5B:
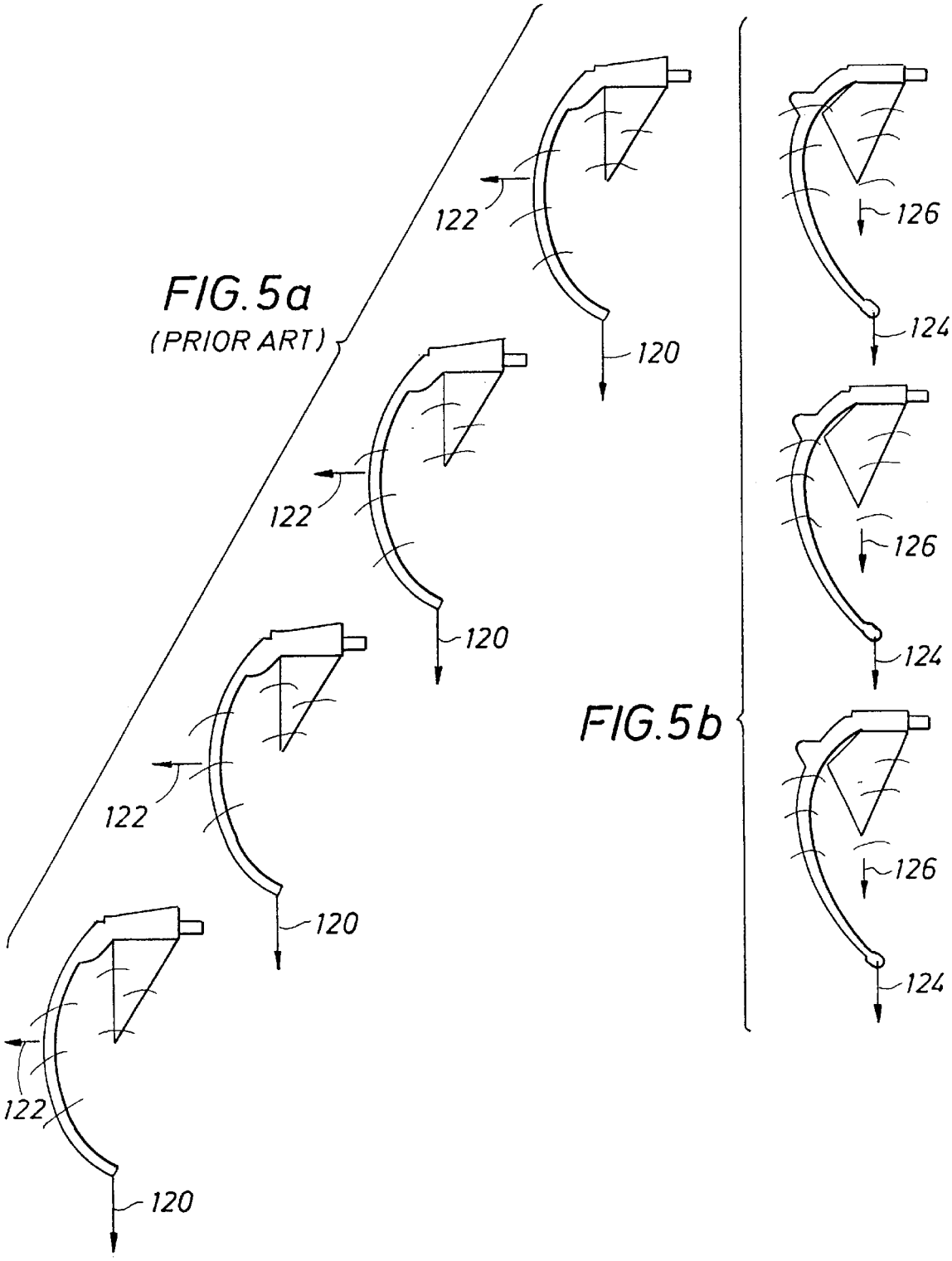
FIG. 5a (PRIOR ART)
FIG. 5*a* depicts series of silhouette images of the effects of crabbing on a prior art anchor with a triangular fluke.
FIG. 5*b* depicts a series of silhouette images of the straight pull on an anchor with a trapeziform fluke of this invention.

FIGS. 5*a* and 5*b* show a side-by-side comparison of the dragging effects of the prior art anchor of FIG. 1 and the anchor of this invention shown in FIGS. 1*a* and 2*b*. As shown in FIG. 5*a,* as force is applied by a force vector 120, the bottom material exerts a sideways force 122, causing the anchor to crab sideways. This is the result of the total force on the triangular fluke, even with center of force positioned on the perpendicular 28 (see FIG. 3*a*). However, this sideways force 122 is eliminated by the trapeziform fluke of FIG. 5*b,* with the anchor being pulled by a force 124. This is because the sideways forces resulting from the bottom material cancel left and right, leaving only the force vector 126, and because the center of effort of the fluke is perpendicular to the load.

FIGS. 6*a* and 6*b* through FIGS. 11*a* and 11*b* show comparisons of the prior art anchor of FIG. 1 and the anchor of this invention shown in FIGS. 2*a* and 2*b,* as various structural aspects are modified in an effort to correct some adverse effect of the triangular fluke. In each instance, correction for one adverse effect exacerbates some other drawback of this anchor.

Figure 6A:
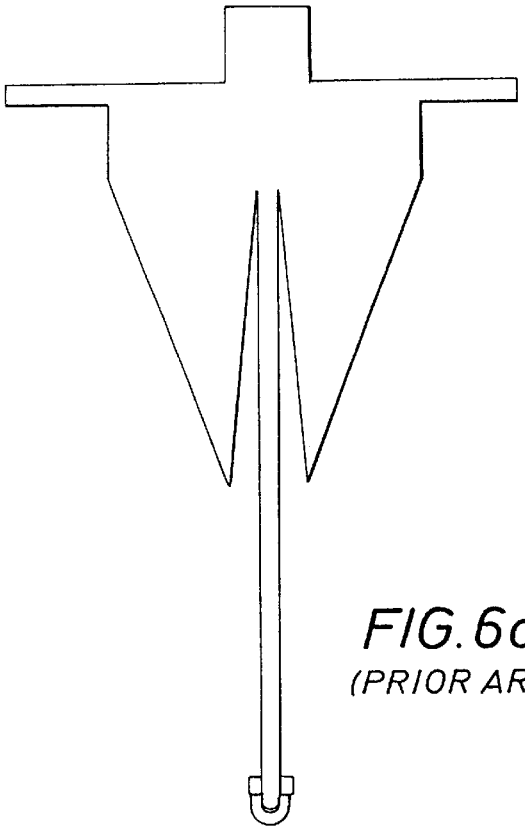
FIG. 6a (PRIOR ART)
FIG. 6*a* is a plan top view in silhouette of a prior art anchor with symmetrical flukes either side of a straight shank which is prone to clogging with an accumulation of bottom of material when the anchor drags.
Figure 6B:
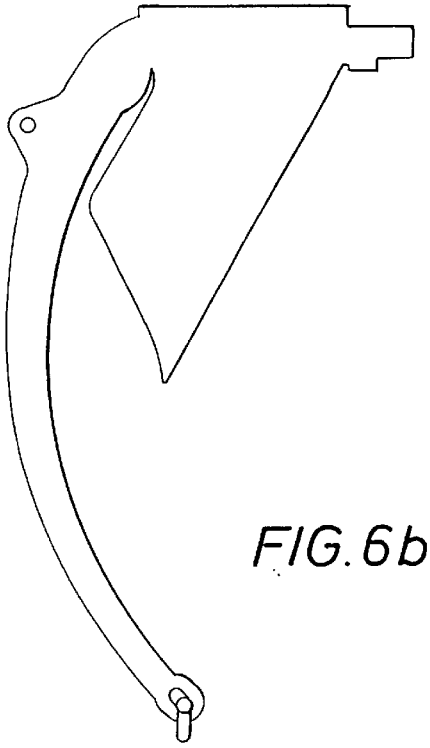
FIG. 6*b* is a plan top view in silhouette of an anchor of this invention with a trapeziform fluke coupled to an arched shank which reduces the tendency of the anchor to accumulate bottom of material when the anchor drags.

For example, one way to reduce the effects of crabbing is to mount a matched fluke on the other side of a straight shank, as shown in FIG. 6*a*. As mentioned above, however, this results in greater accumulation of bottom material at the intersection of the shank and the flukes, and reduces the penetrating effectiveness of the anchor. Such an adverse effect is not present with the trapeziform fluke of FIG. 6*b,* since the arched shank falls away from the fluke to permit bottom material to move off the fluke evenly on either side.

Figure 7A:
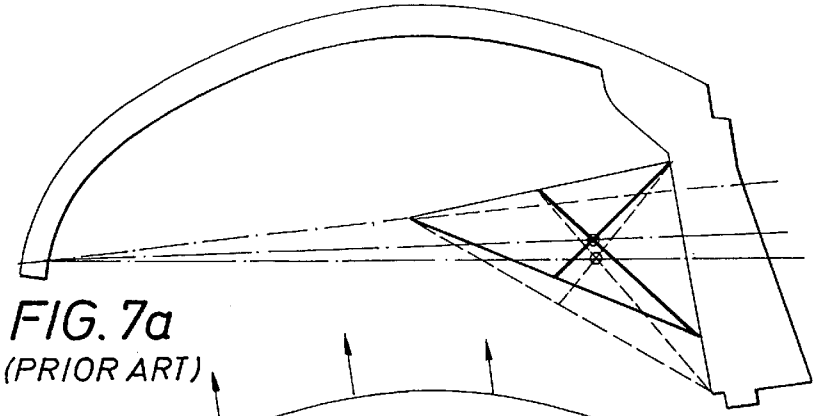
FIG. 7a (PRIOR ART)
FIGS. 7*a*–7*c* depict the effects on a prior art anchor with a triangular fluke of increasing the size or area of the fluke, thus moving the center of effort even further off the perpendicular from the end of the shank to the leg of the shank holding the fluke.
Figure 7B:
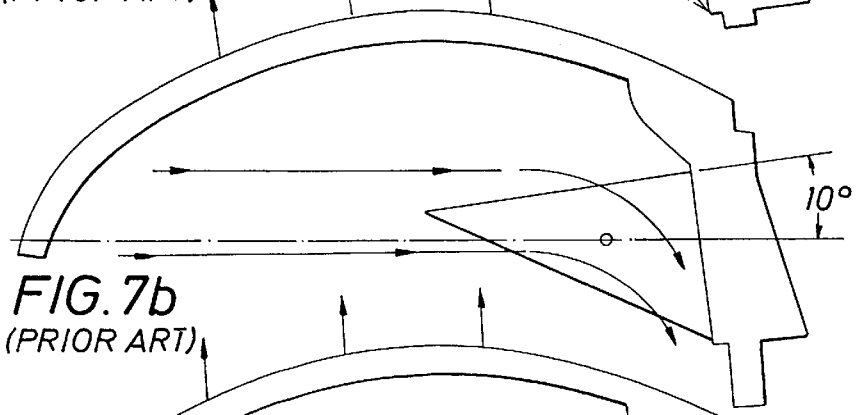
FIG. 7b (PRIOR ART)
Figure 7C:
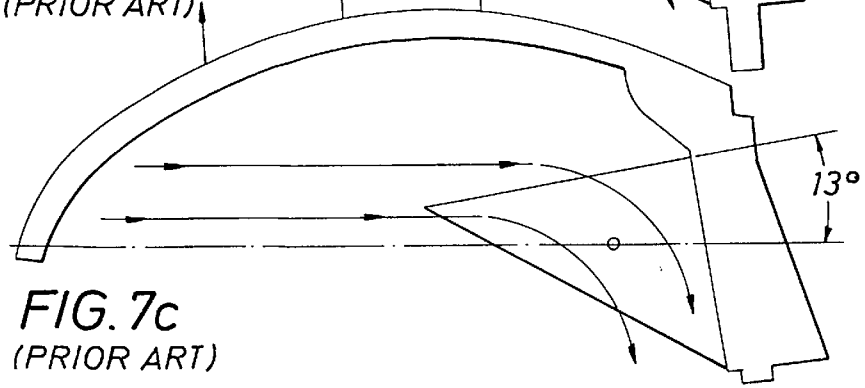
FIG. 7c (PRIOR ART)

FIGS. 7*a,* 7*b,* and 7*c* illustrate the conclusions reached by efforts to simply increase the surface area of the triangular fluke. By inspection, it can be seen that simply enlarging the fluke area just increases the side forces on the anchor and does not prevent the crabbing of the anchor.

Figure 8A:
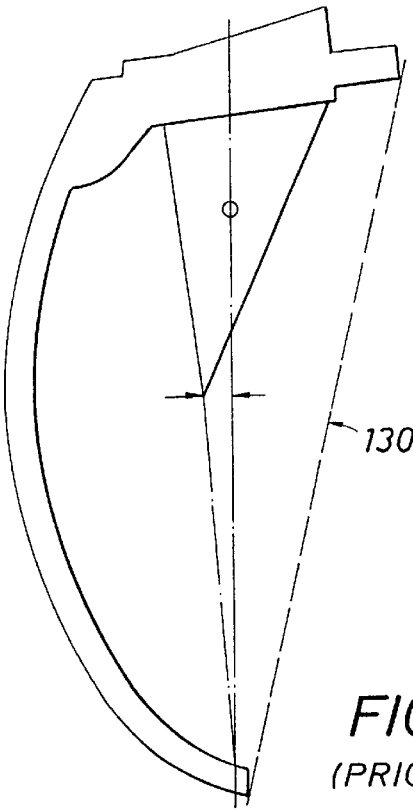
FIG. 8a (PRIOR ART)
FIGS. 8*a* and 8*b* compare the respective effects on the anchors if one maintains the tips of the respective flukes as close as possible to the perpendicular.
Figure 8B:
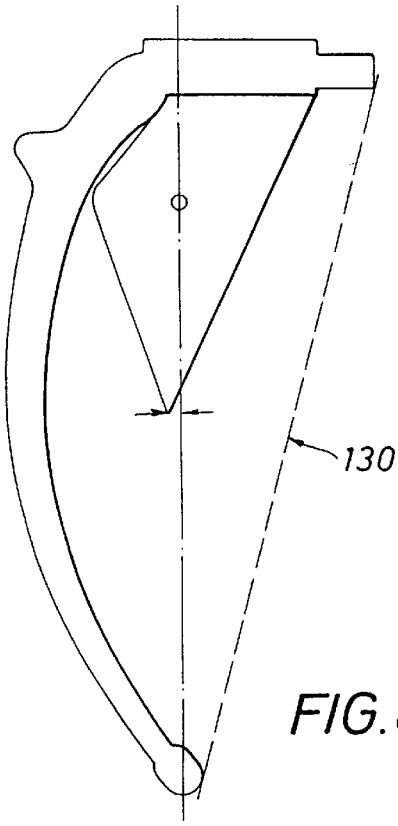
Figure 10A:
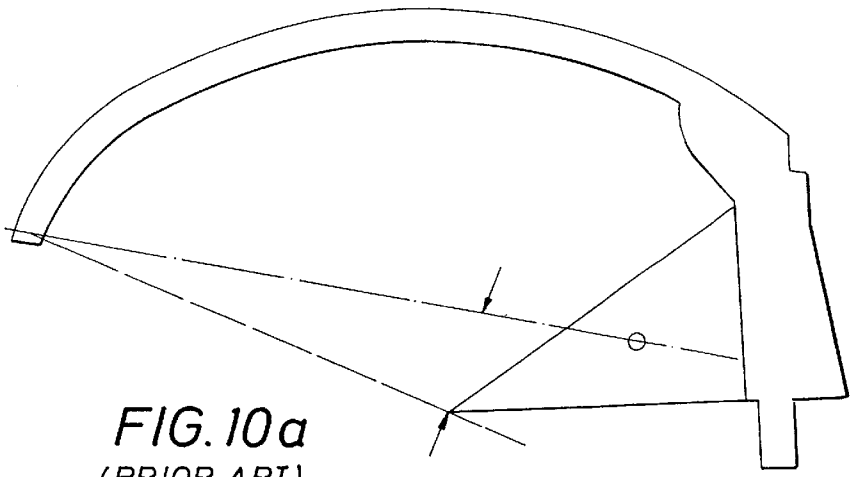
FIG. 10a (PRIOR ART)
FIGS. 10*a* and 10*b* compare the respective effects on the anchors if the tip of the triangular fluke is positioned outside the perpendicular.
Figure 10B:
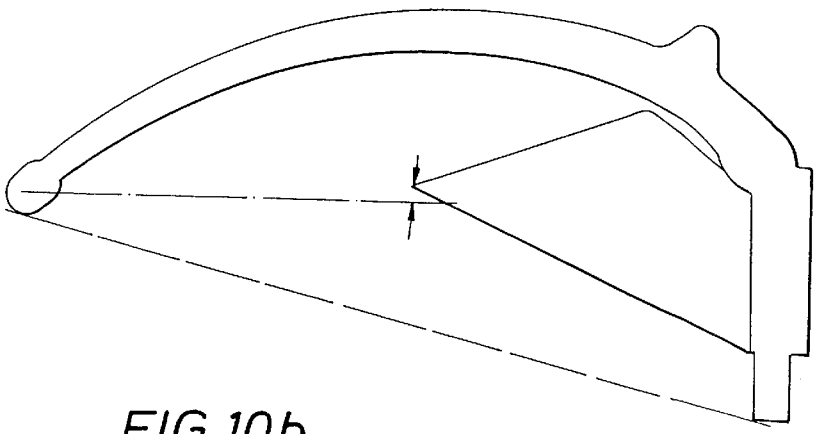

The closest that the triangular fluke can come to satisfactory performance is achieved by placing the fluke tip as close as possible to the line of perpendicular pull, as shown in FIG. 8*a*. This arrangement maintains the clearance between the tip of the fluke and the line 130 between the ends of the shank. This clearance provides adequate penetrating angle, but the crabbing tendencies of this anchor are inherent as described above. In very hard bottom conditions, this slight misalignment will cause this anchor to trip itself and roll out of the bottom. On the other hand, the trapeziform fluke of FIG. 8*b* prevents rolling out of the bottom or cork-screwing and promotes a constant penetration down into the bottom. For ideal performance, the elements A (center of effort), B (fluke tip), and C (shank end) of FIG. 8*b* should all be as close as possible to the perpendicular line 28.

Figure 11A:
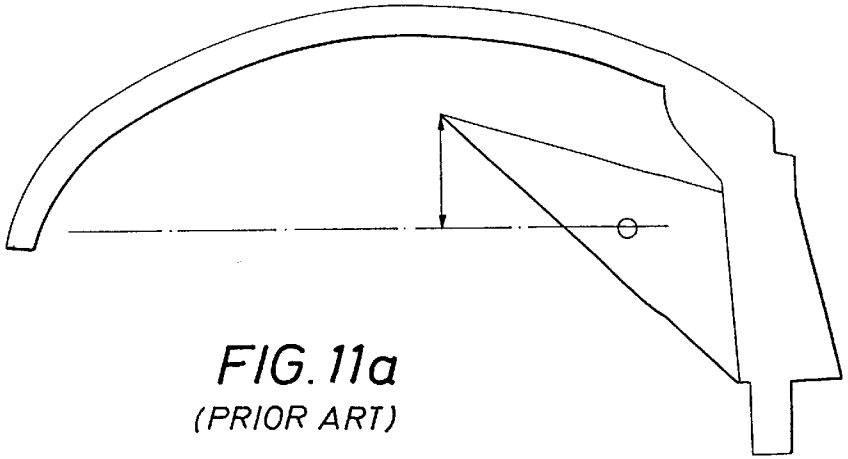
FIG. 11a (PRIOR ART)
FIGS. 11*a* and 11*b* compare the respective effects on the anchors if the tip of the triangular fluke is positioned real close to the shank, thereby closing the penetrating clearance angle on the shank side of the fluke.
Figure 11B:
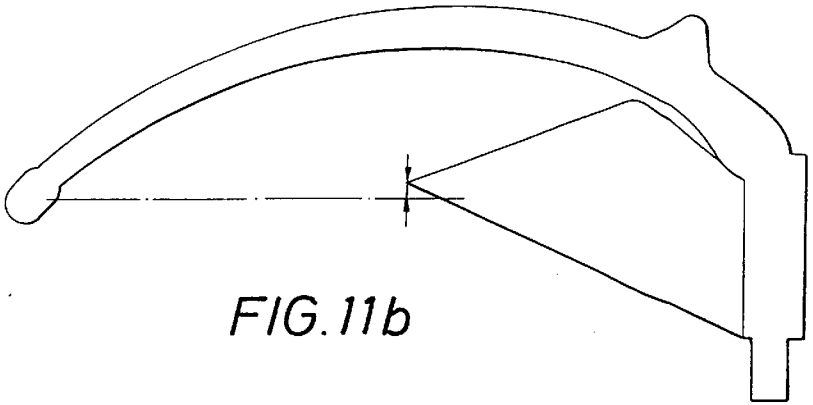
Figure 9A:
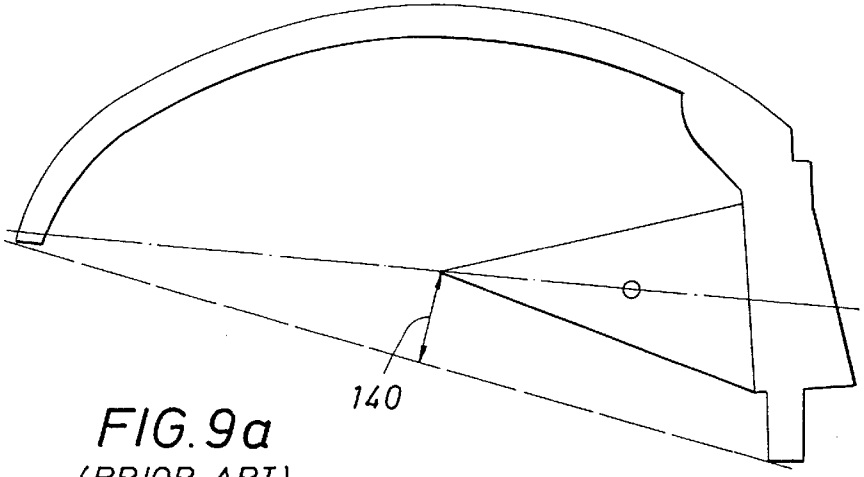
FIG. 9a (PRIOR ART)
FIGS. 9*a* and 9*b* compare the respective effects on the clearance between the tips of the flukes and the line between the ends of the shank, demonstrating the effect on the relative penetrating power of the anchor.
Figure 9B:
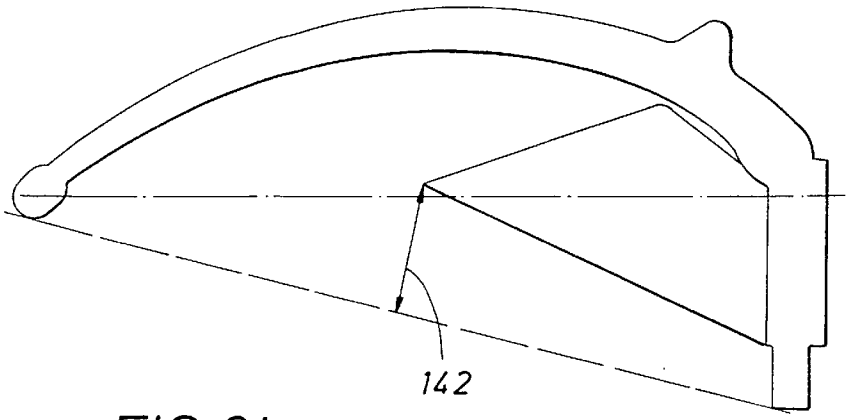

Finally, FIGS. 9*a,* 9*b,* 10*a,* 10*b,* 11*a,* and 11*b* illustrate the effects of moving the fluke tip closer to or further away from the arched shank. With the fluke tip aligned along the line between the center of effort and the end of the shank, as in FIG. 9*a*, such alignment narrows the clearance 140 required for adequate penetrating angle on the open side of the anchor. Greater clearance 142 is provided by the trapeziform fluke. This effect is especially exacerbated if the tip of the fluke is moved outside the perpendicular, as in FIG. 10*a*. The pressure apexes at the enter of effort, fluke tip, and point of load at the shank are so mis-aligned and out of balance that this anchor will not set in any bottom condition, soft or hard, and will only scrape the bottom. The weight of the shank will maintain the horizontal orientation of the anchor, but the fluke will not be able to penetrate the bottom. Moving the tip of the fluke toward the closed side as shown in FIG. 11*a,* closes the penetrating clearance angle on the shank side and pressure apexes at the center of effort, fluke tip and the end of the shank are once again out of alignment. This anchor will roll out of the bottom because the fluke tip interrupts the necessary alignment of the pressure areas, which "trips" the anchor and prevents it from setting. This misalignment creates a corkscrew condition, wherein the anchor will roll into and out of the bottom repeatedly as the anchor is dragged.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. An anchor of the type intended to be connected by a cable to a craft so as to be engaged in a bed and thereby to releasably moor a craft, said anchor comprising:

(a) a shank having a major leg and a shorter leg, the major leg having a forward and a rearward end, the legs being angularly joined at a juncture located at the rearward end of the major leg;

(b) the shank having a connection means, the shank being engaged by the cable at the forward end of the major leg by the connection means;

(c) a trapeziform fluke pivotally secured for pivotal movement about an axis extending along said shorter leg, said fluke being pivotal with respect to said shank so as to be capable of moving said rearward end upward with respect to said bed, and at least a part of said fluke being engageable with the bed thereby causing force which is applied by the cable to the connection means to be transferred to the fluke, the trapeziform fluke defining a center of force that is substantially on a line extending from the forward end of the major leg and forming a right angle with the shorter leg; and (d) the shank at the major leg curving away from the fluke so that it extends in a plane defined by the major and shorter legs, and extends away from the fluke, and said part being substantially prevented from pivoting about the shorter leg axis by said cable, causing said shank to pivot with said fluke in at least one plane about said part so as to substantially be capable, in response to the cable pulling upon the forward end, of moving in an oscillatory path in said one plane to thereby cause the fluke to more readily enter the bed.

2. An anchor as recited in claim 1 wherein said fluke is substantially alignable within said first mentioned plane, said fluke pivots with respect to said shank on either side of said first mentioned plane to an acute angle and said shorter leg axis is substantially within said first mentioned plane.

3. An anchor as recited in claim 2 wherein said fluke comprises a substantially planar palm being substantially alignable co-planar with said first mentioned plane.

4. An anchor as recited in claim 3 wherein said planar palm is pivotal to an acute angle on either side of said first mentioned plane.

5. An anchor as recited in claim 4 wherein said palm is a substantially trapezium-shaped blade, said part engageable with the bed being at least a point of said trapezium.

6. An anchor as recited in claim 5 wherein said angularly joined legs form a generally L-shaped member and the shorter leg axis coincides with the shorter leg of said "L".

7. An anchor as recited in claim 6 wherein said fluke comprises a hollow cylindrical tube-like member, said palm extends radially from said cylindrical member, said cylinder is disposed for pivotal movement upon said shorter leg.

8. An anchor as defined in claim 7 wherein the major leg is comprised of a curved portion, the convexity of the curved portion extending in said first mentioned plane away from the fluke, and said part of the shank curving away from the fluke is comprised of the curved portion.

9. An anchor as recited in claim 8 wherein said fluke further comprises a stiffener extending vertically from the palm.

10. An anchor as recited in claim 1 wherein said oscillatory motion and said curved part permits the anchor to be engageable with the bed upon a scope substantially equal to or greater than 2:1.

11. An anchor comprising:

(a) an L-shaped shank lying substantially within a shank plane, the shank having a major leg and a shorter leg, (b) a fluke pivotally secured to the shorter leg of said shank for pivotal rotation thereabout to at least an acute angle; said fluke comprising a substantially planar trapeziform palm having a bed-engaging point, the fluke defining a center of force that is substantially on a line extending from the forward end of the major leg and forming a right angle with the shorter leg;

(c) the major leg having a cable attachment means fixed to a forward end thereof, the forward end being that end of the major leg which is furthest from the shorter leg; and (d) the major leg further comprising a curved portion, the convexity which extends within said plane away from the fluke, the curved portion being engageable with a bow roller so as to act as a stowing guide by rotationally aligning the anchor axially in the general direction that the cable and anchor are withdrawn past the bow roller.

12. An anchor as recited in claim 11 further comprising means for limiting said pivotal movement of said fluke to an acute angle on either side of said shank plane.

13. An anchor as recited in claim 12 wherein said acute angle is approximately 43° on either side of the plane.

14. An anchor as recited in claim 13 wherein said palm comprises a trapeziform blade and the curved portion forms an arc segment.

15. The anchor of claim 11 wherein the convexity of the curved portion extends away from the fluke substantially beyond a line of force passing from the cable attachment through the fluke as a result of the cable pulling the anchor along a sea bed, thereby permitting the curved portion to rotate about an axis roughly defined by said line of force, causing the curved portion to engage the ground.

16. An anchor as recited in claim 15 wherein said rotation further permits the anchor to be engageable with the bed upon a scope substantially equal to or greater than 2:1.

* * * * *